United States Patent [19]

Kai

[11] Patent Number: 4,543,279

[45] Date of Patent: Sep. 24, 1985

[54] PLASTIC FILM PRODUCT

[75] Inventor: Hisao Kai, Chiba, Japan

[73] Assignee: Taisei Kako Kabushiki Kaisha, Tokyo, Japan

[21] Appl. No.: 472,172

[22] Filed: Mar. 3, 1983

[30] Foreign Application Priority Data

Mar. 3, 1982 [JP] Japan ..... 57-33580

[51] Int. Cl.[4] ..... B65D 65/30

[52] U.S. Cl. ..... 428/35; 206/632; 206/820; 428/43; 428/192; 428/906

[58] Field of Search ..... 428/906, 35, 43, 192, 428/193, 343, 461; 206/632, 820

[56] References Cited

U.S. PATENT DOCUMENTS

| | | | |
|---|---|---|---|
| 2,508,855 | 5/1950 | Brown | 206/820 X |
| 2,817,618 | 12/1957 | Hahn | 428/461 X |
| 3,467,250 | 9/1969 | D'Elia et al. | 206/820 X |
| 3,511,436 | 5/1970 | Kessler | 206/632 |
| 3,608,815 | 9/1971 | Bunch | 428/43 X |
| 4,125,665 | 11/1978 | Bemmels et al. | 428/906 X |
| 4,150,184 | 4/1979 | Tesch | 428/43 |
| 4,407,872 | 10/1983 | Horii | 428/35 |

FOREIGN PATENT DOCUMENTS

| | | | |
|---|---|---|---|
| 711603 | 6/1965 | Canada | 206/632 |
| 2909276 | 9/1980 | Fed. Rep. of Germany | 428/43 |

*Primary Examiner*—Henry F. Epstein

*Attorney, Agent, or Firm*—Wenderoth, Lind & Ponack

[57] ABSTRACT

A plastic film product, such as a sealed bag, wound film or adhesive tape, has a plurality of random scratches or cuts having notches toward the other side of the film, formed along the edges thereof so as to be shallow and small enough to be invisible to the naked eye in order to reduce resistance to tearing perpendicular to the edges.

14 Claims, 10 Drawing Figures

PLASTIC FILM PRODUCT

BACKGROUND OF THE INVENTION

1. Field of the Invention:

The present invention relates to plastic film products, such as sealed bags, wound films, adhesive tapes, etc., having a plurality of scratches or cuts formed along the edges thereof so as to be shallow and small enough to be invisible to the naked eye.

2. Description of the Prior Art:

Plastic films are generally thin, light in weight, soft, excellent in transparency and airtightness, and exhibit high strength and, for these reasons, these are widely accepted for actual use. Further, since plastic sheets have thermal plasticity, it is easy to manufacture laminated plastic having paper, metallic foil, cloth, adhesives or other chemicals attached thereto and, therefore, plastic films find extensive utility in many applications.

Since a laminate having metallic foil and polyvinylidene chloride film attached to other plastic, in particular, is excellent in airtightness and is sufficiently sealed merely by thermal fusion without using any adhesive, it is used as a dispensing bag for accommodation of various kinds of wares such as foodstuffs, medical supplies, small articles, etc. of various forms such as of liquid, powder, paste, solid and so on. However, these sealed dispensing bags have a disadvantage that since the plastic material of which the bags are made has toughness it is difficult to break the seal in taking the contents out of the bags. In spite of such toughness, once the plastic material is injured, the injury tends to be easily propagated. Accordingly, by giving a cut to the edge portion of the bag to be torn open, it is possible for a person to easily break the seal through the cut by applying a stretching force with his fingers.

In consideration of the properties of the plastic material as described above, there have heretofore been adopted a method for forming a cut in advance in the edge portion of the bag attached by fusion and a method for cutting a V-shaped notch in the edge portion. However, the former method is disadvantageous in that the place where the cut portion is formed in the edge portion of the bag cannot easily be found. In the latter method, it is easy to find the V-shaped notch, but the triangular cut pieces are dispersed in effecting the bag-making and bag-filling treatments on a large scale to thereby make the working environment worse.

In either method, since the number of cuts or the like is limited to one, sometimes the cut is not formed in a desired position and since the cut is propagated in a reluctant direction, the filler may be dispersed to the surroundings. Furthermore, the typical cut of the prior art has a depth of about 2 mm and the cut portion exhibits low impact resistance. For this reason, provision of a great number of such cuts will reduce the strength of bags when distributed or stored and make the manufacturing processes complicated and, therefore, cannot be adopted.

There also exists a plastic sheet product having its entire edge portion formed in the shape of sawteeth. However, since the concave portions of the sawteeth either have relatively obtuse angles or are rounded, the effect of initial cutting cannot fully be expected and, therefore, such a product is not suitable for use as a dispensing bag of a thick film having liquid, emulsion, paste or hygroscopic substances sealed therein.

In the case of wound tapes such as adhesive tapes which are used after cutting a given length of the tape unwound, the toughness, one of the merits of plastic sheets, becomes a demerit because a cutting tool is required. Since such a cutting tool as scissors, a knife, etc. is not always laid in the vicinity of the place where the tape is used, the wound adhesive tape is provided generally with a cutter having sawteeth. The sawteeth often graze the user's fingers to be injured. What is worse, since the cut end of the tape is corrugated, the tape is apt to be torn in the lengthwise direction in the subsequent unwinding of the tape, thus bringing about a great cause of the user's failure in unwinding the tape.

As for adhesive tapes capable of being manually cut with the user's fingers without using any cutting tool, there have heretofore been suggested those made of a thin film, a laterally drawn material, etc. It goes without saying that the thin film allows the strength and reinforcement of the tape to be reduced. Although a thin film tape having the rear surface thereof reinforced with paper has been suggested, it is behind a thick plastic film tape in terms of strength.

Plastic tapes having their entire surfaces satinized by sandblasting, on which any letter or symbol can be written with writing tools such as pencils etc., are available on the market. Letters and symbols remain on the tape due to the filling of the components of a writing tool into the concaves of the satinized surface. However, since the tapes of this kind are much inferior in strength and do not have sufficient reinforcing effects, these are used merely in the form of adhesive labels bearing optional letters and/or symbols thereon.

SUMMARY OF THE INVENTION

In view of the various disadvantages suffered by the conventional plastic film products mentioned above, the present invention has been accomplished.

One object of the present invention is to provide a plastic film product capable of substantially retaining intact the high strength and other merits a plastic film per se exhibits, which can be cut manually from a given position by force applied only by a person's fingers without use of any cutting tool, and thus being considerably useful from a practical point of view.

To attain the objects described above, according to the present invention, there is provided a plastic film product having a multiplicity of scratches or cut formed randomly and densely on the edge portions thereof along the lines of the edge portions.

These and other objects and characteristic features of the present invention will become apparent from the following description which is given in detail with reference to the accompanying drawings.

Figure 1:
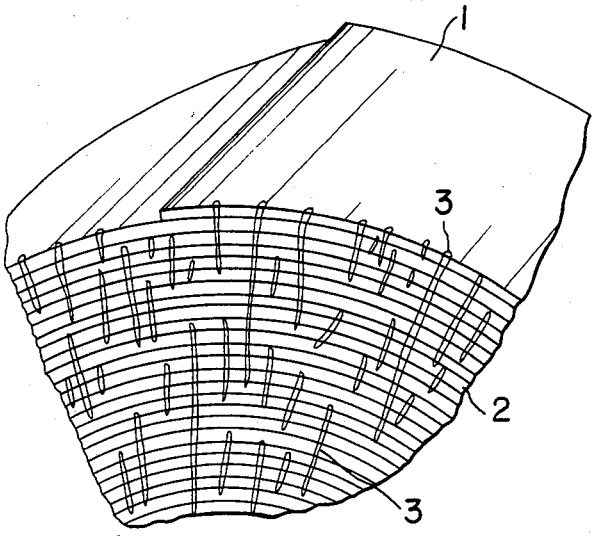
FIG. 1 is a partially enlarged schematic view showing a wound film according to the present invention.

DETAILED DESCRIPTION OF THE PREFERRED EMBODIMENTS:

Plastic sheets usable for the purpose of the present invention are those which are tough enough not to be cut ordinarily by the manual force of a user's fingers and are made of any one of polyethylene, polypropylene, polyvinyl chloride, polyvinylidene chloride and the like, any laminate of these materials, or any laminated plastic composed of any of the materials and metal, paper, cloth, adhesives, etc. The plastic sheets are processed into bags or lengthy substances such as wound tapes, adhesive tapes, etc. having a plurality of scratches or cuts having notches toward the other side of the sheets formed on the edge portions thereof along the lines of the edge portions so as to be slender, shallow and small enough to be invisible to the naked eye. These scratches differ from the deep and sharp cuts or the like formed with a cutting tool by the conventional techniques, are shallowly formed such as by simple roughened-surface processing along the edge lines of a product in an optional direction such as from one cross-sectional surface toward the other cross-sectional surface of the product, from the surface of the edge portion to the width direction of the product, for example, and little reduce the strength of the product. In spite of the fact that the scratches or cuts are too minute to externally find any change of the product, the product can easily be torn through the scratches or cuts from an optional position of the line of the edge of the product by the force of the fingers in such a manner that the edge portion of the product is picked up between the fingers and stretched in a direction perpendicular to the edge line to form a cut line and allow the cut to be enlarged and propagated.

The width and density of the scratches arranged linearly vary depending on the kind and thickness of the sheet to be used. However, there are formed at least five scratches or cuts, preferably more than 20 scratches or cuts and more preferably more than 100 scratches or cuts, per centimeter of the length of the edge line.

A plurality of these minute scratches or cuts can easily be formed on the edge portions of a film which will become the edge portions of a product by rotating an abrasive such as a disc-shaped or cylindrical rotary grindstone, wire brush, grain-containing sheet material, etc. and longitudinally reciprocating the abrasive or moving the abrasive and the sheet relative to each other to carry out fretting or pressing treatment. The depth of the scratches or cuts is determined by the particle size of the grains on the abrasive. Therefore, an abrasive provided with grains having a particle size suitable for a film to be processed is used. In any event, the scratches or cuts have a size smaller than the particle size of the grains. Thus, the product of the present invention are fundamentally different in size and number of the scratches or cuts from the conventional products each having a single large cut formed therein.

When a sheet is thick and difficult to tear, it is processed by using an abrasive with coarse grains while pressing the abrasive with large pressure to have a multiplicity of wide and sharp scratches or cuts. These scratches or cuts are linearly formed on the portions of the surface of a film which will finally become edge portions of a product after a cutting step when the pressing or, fretting process is effected on the surface of the film by use of an abrasive and, when the pressing or fretting process is carried out on the edge portion of a film or tape wound in the shape of a roll, these scratches or cuts are formed on the edge portion.

The present invention will now be described more specifically with reference to the accompanying drawings.

Figure 2:
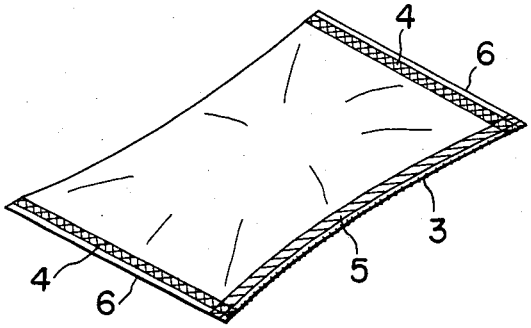
FIG. 2 is a perspective view illustrating one embodiment of the sealed bag according to the present invention.

FIG. 1 is a partially enlarged schematic view showing a film which has been wound in the shape of a roll. Denoted by reference numeral 1 is a polypropylene film which has a plurality of scratches 3 formed on the cross-sectional portion 2 thereof by bringing a rotating wire brush (not shown) into intimate contact with the cross-sectional portion. The rolled film is unwound and, by use of a known automatic bag-making and bag-filling apparatus, filled with confectionery and formed into a three-side sealed dispensing bag as illustrated in FIG. 2. In FIG. 2, reference numeral 4 denotes lateral fusion attached portions and reference numeral 5 a longitudinal fusion attached portion. In manufacturing a bag, the lateral portions of a sheet are fusion attached and immediately the film is cut into a bag, and subsequently the bag is filled with a filler. Reference numeral 6 represents a lateral cut end. In this embodiment, a known bag-making and bag-filling apparatus is used and a feed roll of plastic film used has merely its both edge portions subjected to processing. However, since a plurality of scratches 3 are formed on the longitudinal edge portion of the sealed dispensing bag thus manufactured, the bag can easily be torn from an optional position of the longitudinal edge portion.

Figure 3:
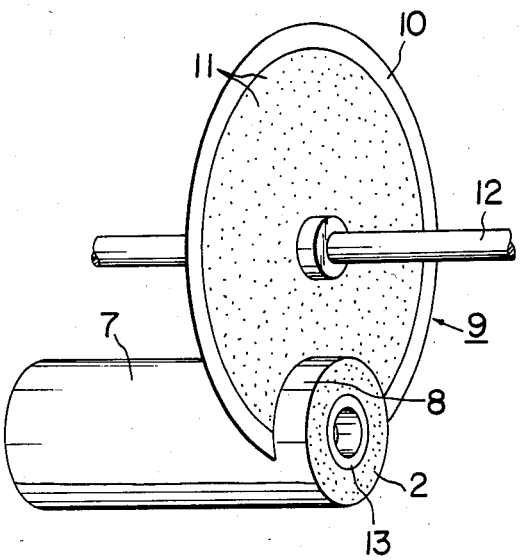
FIG. 3 is a perspective view illustrating the state wherein a wound film is subjected to processing to obtain the plastic film product according to the present invention.

FIG. 3 is a perspective view showing another processing method to obtain the plastic film product according to the present invention, which process is adapted to process a wound film. A feed roll of plastic sheet 7 is cut off to obtain a wound film 8 of a given width. Denoted by reference numeral 9 is a disc-shaped cutter provided on the circumferential portion thereof with a continuous edge 10 and having grains 11 attached to its both surfaces to serve as abrasives, and denoted by reference numeral 12 is a rotary shaft. In proportion as the cutting of the feed roll 7 proceeds deeply, the surfaces which are now being cut are fretted by means of the abrasives on both surfaces of the cutter and, upon completion of the cutting step, a plurality of random scratches having notches toward the other side of the film are formed on the edge portions of the wound film and the feed roll, and the processing for breaking the seal is effected. In FIG. 3, a core of the wound film 8 is designated by reference numeral 13.

Figure 4:
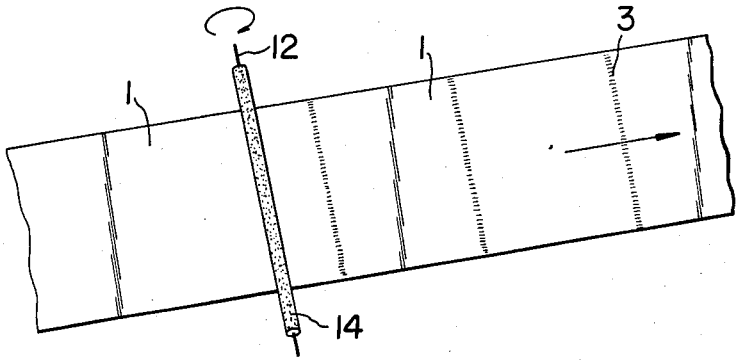
FIG. 4 is a perspective view illustrating the state wherein a sheet is subjected to processing to obtain the plastic film product according to the present invention.

FIG. 4 illustrates another embodiment of the processing method to obtain the plastic film product according to the present invention. Reference numeral 1 designates a sheet having undergone a printing process, which is fed in the direction shown by the arrow in FIG. 4, then wound in the shape of a roll, and subjected to a bag-making and bag-filling treatments. A slender cylindrical abrasive 14 having its circumferential surface serving as a grain surface is disposed at right angles relative to the film feeding direction and rotated around the rotary shaft 12. This abrasive 14 repeats its longitudinal reciprocation and, when it reaches its lowermost position during the longitudinal reciprocation, it comes into contact with the moving film 1, thereby pressing or fretting the film by means of the grains formed on the surface of the abrasive 14, with the result that a plurality of scratches 3 parallel to the film feeding direction are formed on the film along a line intersecting the film. The aforementioned scratches 3 may be formed by disposing a non-rotatable abrasive so as to intersect the film, longitudinally reciprocating the abrasive and moving the sheet alone, thereby fretting the film by means of grains.

As occasion demands, longitudinal scratches may be formed on the edge portions of a film by disposing abrasives 14 one each in contact with the edge portions of the moving film in parallel with the film feeding direction and rotating the abrasives. Further, when scratches are formed on the front and rear surfaces of a film which will become the edge portions of a bag, there can be obtained a dispensing bag which is much easier to tear off.

Figure 5:
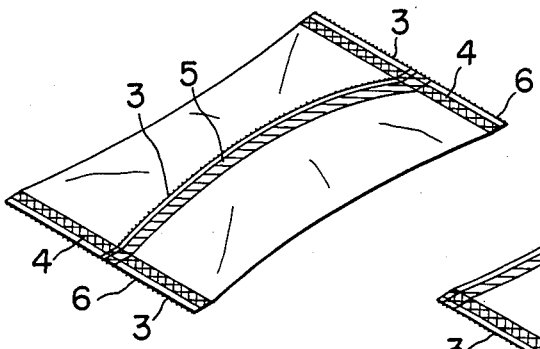
FIG. 5 is a perspective view illustrating another embodiment of the sealed bag according to the present invention.

The cross-sectional portions of the wound film 8, subjected the process as shown FIG. 4 have been further subjected to the processing as shown in FIG. 1. Then a bag has been manufactured from the wound film and filled with sugar by use of an ordinary bag-making and bag-filling apparatus to obtain a pillow-shaped sealed dispensing bag as shown in FIG. 5. In this case, since the central portion of a plurality of linearly arranged scratches shown in FIG. 4 is set to become the lateral cut end 6, the seal of the bag can be broken from any position on the edge portions of the lateral and longitudinal fusion attached portions 4 and 5.

Figure 7:
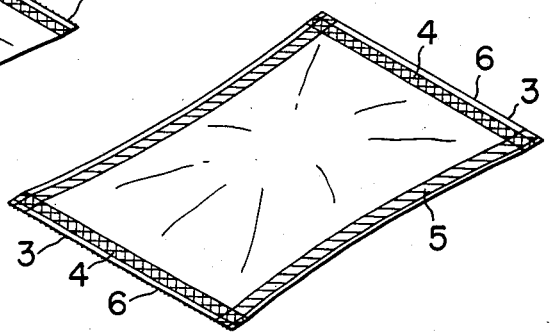
FIG. 7 is a perspective view illustrating still another embodiment of the sealed bag according to the present invention.
Figure 6:
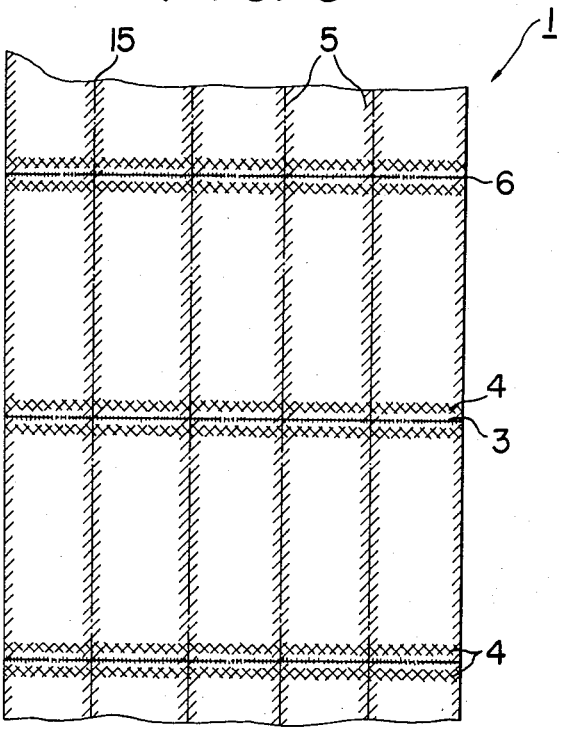
FIG. 6 is a plan view illustrating a sheet for the manufacture of sealed bags which sheet has undergone the processing to obtain the bag according to the present invention.

FIGS. 6 and 7 show the embodiment of the present invention, wherein a four-side sealed dispensing bag having kneaded mustard contained therein has been manufactured. In FIG. 6, reference numeral 1 denotes a film which is in a state of being either wound or unwound prior to the treatment of a wound film with a bag-making and bagfilling apparatus and which has a plurality of scratches formed densely thereon in a direction intersecting the sheet by the method illustrated in FIG. 4. The central line of a plurality of scratches 3 densely arranged is a lateral end 6 to be cut. Denoted by reference numeral 4 are portions to become lateral fusion attached portions when a four-side sealed bag is manufactured, as shown in FIG. 7, and denoted by reference numeral 5 are portions to become longitudinal fusion attached portions when the four-side sealed bag is manufactured. In this embodiment, a four-side sealed dispensing bag as shown in FIG. 7 is manufactured by use of an automatic bag-making and bag-filling apparatus having a system such that longitudinal fusion attached portions are formed in a plurality of rows and that fillers are introduced from separate nozzles between the adjacent rows of the longitudinal fusion attached portions. In this embodiment, therefore, a plurality of scratches are formed on the edge portions of the lateral fusion attached portions. Denoted by 15 are portions 4 to be cut longitudinally.

In all the embodiments described above, known automatic bag-making and bag-filling apparatuses and wound film treated in advance have been used. However, the processing described above may be effected simultaneously with the bag-making and bag-filling treatments using an ordinary wound sheet by disposing a longitudinal or lateral abrasive between the seal portion and the cutter of the bag-making and bag-filling apparatus or at an optional position between the location of unwinding treatment of the wound sheet and the location of bag-making treatment.

Figure 8:
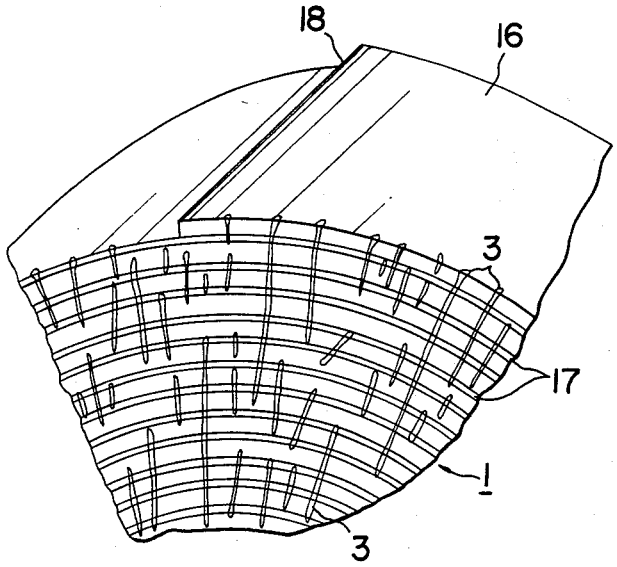
FIG. 8 is a partially enlarged schematic view showing an adhesive tape according to the present invention.

FIG. 8 is a perspective view showing an adhesive tape according to the present invention. This adhesive tape is a plastic sheet product obtained by cutting off a feed roll of adhesive tape having a large width with the cutter shown in FIG. 3. The cut surface of the adhesive tape 16 has been fretted by the abrasives formed on both surfaces of the cutter and has formed thereon a plurality of scratches 3 upon completion of the cutting treatment. Reference numeral 17 designated an adhesive agent and reference numeral 18 designates an initial end for unwinding the adhesive tape. Although the external appearance and strength of the adhesive tape which is a plastic sheet product of the present invention do not differ from those of an ordinary adhesive tape, a given length of the adhesive tape of the present invention unwound from the initial end could easily be cut at right angles relative to the lengthwise direction by the force of the fingers only.

Figure 9:
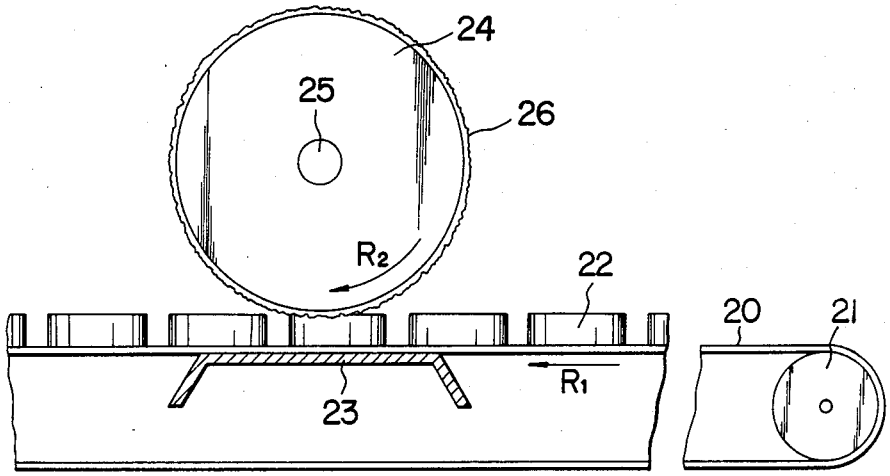
FIG. 9 is a cross-sectional view illustrating another processing method to obtain a plastic film product according to the present invention.

FIG. 9 illustrates another embodiment of the processing method according to the present invention. Reference numeral 20 designates a conveyor belt, and reference numeral 21 designates a pair of the rolls conveying the conveyor belt 20 in the direction shown by the straight arrow in FIG. 9 at a speed R1. The adhesive tape 22 wound in the shape of a roll moves on the conveyor belt to the upper position of a flat table 23, on which the conveyor belt slides arranging the wound adhesive tape 22. Above the flat table 23, a press roll 24 is rotating around the rotary shaft 25 at a peripheral speed R2, in the direction shown by the arched arrow in FIG. 9. The circumferential surface of the press roll 24 is treated to be a abrasive surface 26. The clearance between the lowest surface of the press roll 24 and the conveyer belt 20 positioned on the flat table 23 is smaller than the thickness of the wound adhesive tape 22. When the wound adhesive roll 22 passes below the lowest surface of the rotating press roll 24, the edge portions of the wound adhesive roll is pressed or fretted by the abrasive processed on the circumferential surface of the press roll, forming numerous random scratches, having notches toward the other side of the adhesive tape. If conveyor speed R1 is equal to the peripheral speed R2 of roll 24, the edge portions of the wound adhesive tape are pressed, and the concave surface of the abrasive is copied onto the edge portions of the adhesive tape.

Figure 10:
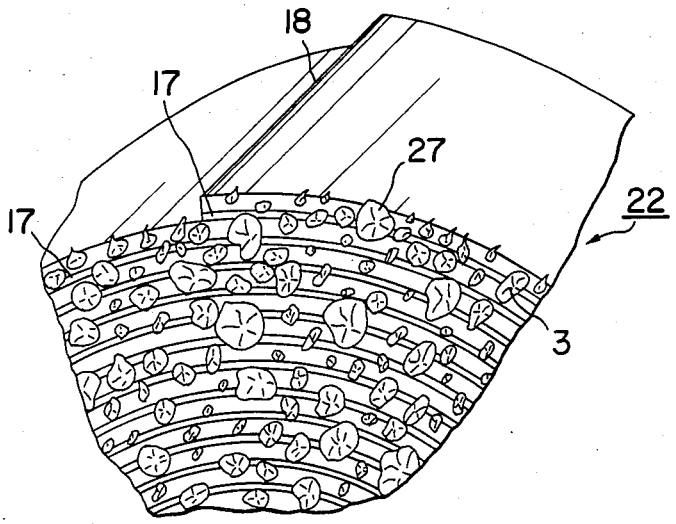
FIG. 10 is a partially enlarged schematic view showing an adhesive tape according to the present invention.

FIG. 10 is a partially enlarged schematic view showing the edge portions of the wound adhesive tape, and most scratches have notches 27 toward the other side of the adhesive tape. In the case of $R1 \neq R2$, the edge portions of the wound adhesive tape are fretted producing elongated scratches, as shown in FIG. 8.

If the outer surface of the conveyer belt 20 is also treated to be a abrasive surface, both edge sides of the wound adhesive tape are processed according to the present invention, and can be easily cut from a given position of the both sides of the wound adhesive tape by the manual force of a person's fingers.

As described above, the present invention substantially solves adverse problems which have heretofore remained outstanding in the conventional plastic film products and, therefore, contributes greatly to this field.

What is claimed is:

1. In a sealed bag formed of plastic film material including two sheets fused together along at least three fused edge surfaces thereof, the improvement wherein a plurality of minute scratches, sufficiently shallow and minute so as to be invisible to the naked eye, are densely formed only on said fused edge surfaces so as to reduce resistance to tearing through said fused edge surfaces perpendicularly thereto without reducing the toughness of interior portions of said sheets.

2. The improvement as in claim 1, wherein said plurality of scratches are formed along substantially the entire extent of each of said at least three fused edge surfaces.

3. The improvement as in claim 2, wherein said two sheets are integrally joined along a common edge having opposite ends intersecting separate ones of said at least three fused edge surfaces.

4. The improvement as in claim 1, wherein the density of said plurality of scratches along said at least three fused edges is at least five scratches per centimeter of length along each of said at least three fused edges, said plurality of scratches being nonuniformly and randomly spaced along said at least three fused edge surfaces.

5. The improvement as in claim 4, wherein the density of said plurality of scratches along said at least three fused edge surfaces is at least twenty scratches per centimeter of length along each of said at least three fused edge surfaces.

6. A wound tape formed of a plastic film material, said tape comprising a plurality of minute scratches, sufficiently shallow and minute so as to be invisible to the naked eye, densely formed only along the entire extents of both side edges thereof so as to reduce resistance to tearing perpendicularly to said side edges, said tape having adhesive formed on at least one side thereof.

7. A wound tape as in claim 6, wherein the density of said plurality of scratches is at least five scratches per centimeter of length of each of said side edges, and said plurality of scratches are nonuniformly and randomly spaced along the length of each of said side edges.

8. A wound tape as in claim 7, wherein the density of said plurality of scratches is at least twenty scratches per centimeter of length of each of said side edges.

9. A plastic film product, comprising a laminate of plastic film and a metal film, said laminate having a plurality of edges, each of said plurality of edges having a plurality of minute, scratches, sufficiently minute and shallow so as to be invisible to the naked eye, densely formed therealong so as to reduce resistance to tearing perpendicularly to said edges.

10. A plastic film product as in claim 9, wherein said laminate comprises a sealed dispensing bag and said plurality of edge surfaces comprise at least three edges sealed by fusion, having said plurality of scratches only therealong.

11. A plastic film product as in claim 9, wherein said laminate consists of a wound tape.

12. A plastic film product as in claim 11, wherein said wound tape comprises a layer of adhesive material on at least one side thereof.

13. A plastic product according to any one of claims 9, 10, 11 or 12, wherein the density of said plurality of scratches is at least five scratches per centimeter of length along each of said plurality of edges, and said plurality of scratches are nonuniformly and randomly spaced along each of said plurality of edges.

14. A plastic film product as in claim 13, wherein the density of said plurality of scratches is at least twenty scratches per centimeter of length along each of said plurality of edges.

* * * * *